United States Patent [19]

Sitkins et al.

[11] 4,199,833

[45] Apr. 29, 1980

[54] CARTON OPENING DEVICE

[76] Inventors: Fred Z. Sitkins, 2239 22nd St.; David A. Hill, 2441 12th St., both of Wyandotte, Mich. 48192

[21] Appl. No.: 880,145

[22] Filed: Feb. 22, 1978

[51] Int. Cl.[2] ..... B66F 15/00

[52] U.S. Cl. ..... 7/166; 81/3 R

[58] Field of Search ..... 7/158, 166; 81/3 R

[56] References Cited

U.S. PATENT DOCUMENTS

| | | | |
|---|---|---|---|
| 2,711,109 | 6/1955 | Gillstrom | 81/3 R |
| 3,629,883 | 12/1971 | Norman | 81/3 R X |
| 3,913,423 | 10/1975 | Gerst | 81/3 R |
| 3,937,005 | 2/1976 | Becker | 81/3 R X |

*Primary Examiner*—James G. Smith

*Attorney, Agent, or Firm*—Gifford, Van Ophem, Sheridan & Sprinkle

[57] ABSTRACT

A carton opening device is provided for opening diverse types of cartons, for example, cartons held together by retaining straps, retaining wires and/or nails. The device comprises an L-shaped handle having a first and second leg. A crowbar claw is formed at the free end of the first handle leg while a diametric channel is formed across the free end of the handle second leg for engaging and breaking retaining wires on cartons. A substantially axial slot extends from the corner of the handle and terminates short of the free end of the handle second leg for engaging and breaking retaining straps on cartons.

4 Claims, 9 Drawing Figures

CARTON OPENING DEVICE

BACKGROUND OF THE INVENTION

I. Field of the Invention

The present invention relates generally to carton opening devices and, more particularly, to such a device with plural means to open diverse types of cartons.

II. Description of the Prior Art

Modern day cartons and containers, hereinafter referred to as cartons for brevity, are secured together during storage and transport in a plurality of different fashions. For example, wood cartons are typically nailed together. Conversely, cardboard cartons oftentimes include a metal wire or strap extending around the carton to secure the carton together despite rough handling.

For persons who open a plurality of cartons, such as persons employed in a shipping and receiving area, it has been the previous practice to carry a plurality of different tools necessary to open the different types of cartons. For example, it is conventional to use a crowbar for opening nailed wooden cartons. Similarly, it is conventional to employ a wire cutter for cutting retaining wires around cartons and, still further, to use a tin snip or similar cutting device to sever the wider retaining bands often found around cartons.

This previous practice for opening different types of cartons is disadvantageous for a plurality of reasons. First, the multiplicity of tools required to open the different types of cartons is not only extensive but these tools also require troublesome and periodic maintenance. Moreover, these plural tools are awkward and cumbersome to carry and store and often-times become lost or stolen thus requiring expensive replacement.

SUMMARY OF THE PRESENT INVENTION

The present invention overcomes the above mentioned disadvantages of the previously known carton opening devices by providing a simple, inexpensive and maintenance free carton opening device capable of opening a plurality of different types of cartons.

In brief, the carton opening device according to the present invention comprises an L-shaped handle having a first leg and a second leg. The handle is preferably cylindrical in cross-sectional shape and of one-piece construction.

A crowbar type claw is formed on the free end of the first leg while a diametric slot is formed across the free end of the second leg. In addition a slot extends from the corner of the handle, substantially axially inwardly toward the free end of the second leg and terminates short of the second leg free end.

The crowbar claw on the handle can be employed as a prying device for opening nailed wooden cartons and the like. The diametric slot across the free end of the second handle leg, on the other hand, is adapted to engage a retaining wire around a carton so that rotation of the second handle leg about its axis via the first handle leg stretches the retaining wire and causes it to rapidly break.

The axial slot in the second leg of the handle is similarly adapted to receive the wider retaining band of a carton therein. Thereafter, pivotal action or rotation of the carton opening device about the axis of the handle second leg causes the retaining band to stretch, rapidly harden and break.

BRIEF DESCRIPTION OF THE DRAWINGS

A better understanding of the present invention will be had upon reference to the following detailed description when read in conjunction with the accompanying drawing, wherein like reference characters refer to like parts throughout the several views, and in which.

DETAILED DESCRIPTION OF THE PRESENT INVENTION

Figure 1:
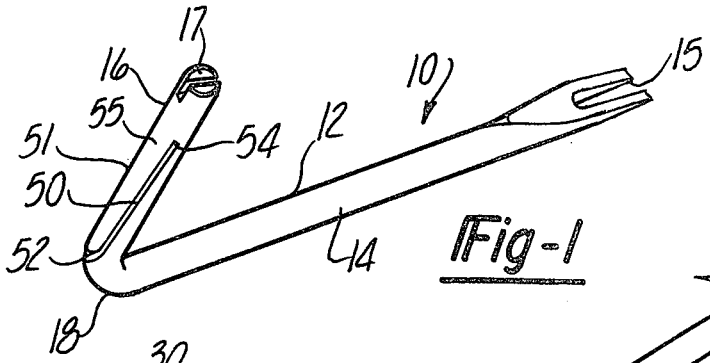
FIG. 1 is a perspective view showing the carton opening device according to the present invention.

With reference first to FIG. 1, the carton opening device 10 according to the present invention is thereshown and comprises an L-shaped handle 12 having a first leg 14 and a second leg 16. The legs 14 and 16 are joined together at one end and form a corner 18 so that the legs 14 and 16 each include a free end 15 and 17, respectively. In addition, the handle 12 is preferably of a one-piece construction and has a circular cross-sectional shape.

Figure 2:
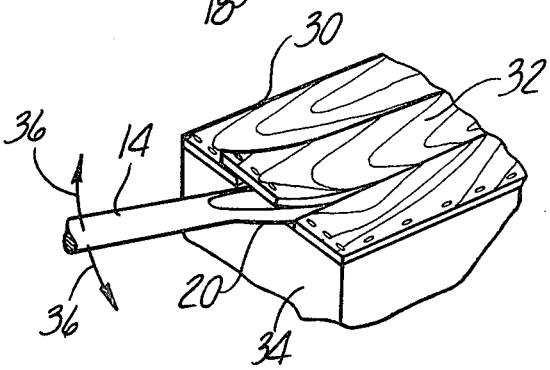
FIG. 2 is a fragmentary perspective view showing the carton opening device of the present invention opening nailed wooden carton.
Figure 5:
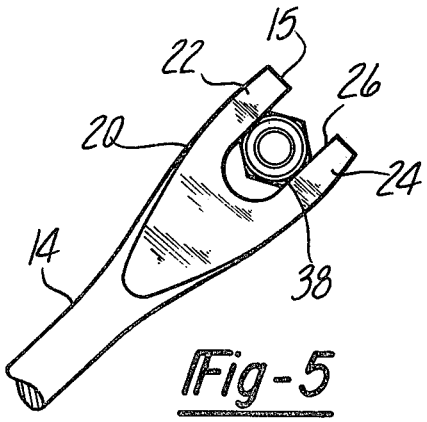
FIG. 5 is a fragmentary plan view showing the carton opening device according to the present invention in use as a wrench.

With reference now to FIGS. 1, 2 and 5 a claw 20 is formed at the free end 15 of the handle leg 14. The claw 20 further comprises a pair of relatively flat and axially outwardly extending prongs 22 and 24. The prongs 22 and 24 are spaced and parallel from each other and form a generally U-shaped channel 26 therebetween. The overall width of the claw 20 is greater than the diameter of the handle leg 14.

As best shown in FIG. 2 since the claw 20 is relatively flat, it can be used to pry open a nailed carton 30 by wedging the claw 20 between a carton slat 32 and a carton sidewall 34. Thereafter, the handle leg 14 is pivoted in the direction indicated by arrows 36 to produce the prying force necessary to open the carton 30.

With reference now particularly to FIG. 5, the U-shaped channel 26 formed between the claw prongs 22 and 24 can also be advantageously employed as an open end wrench to engage and rotate a nut 38. Many cartons employ securement nuts 38 for holding the carton or its contents together.

Figure 3:
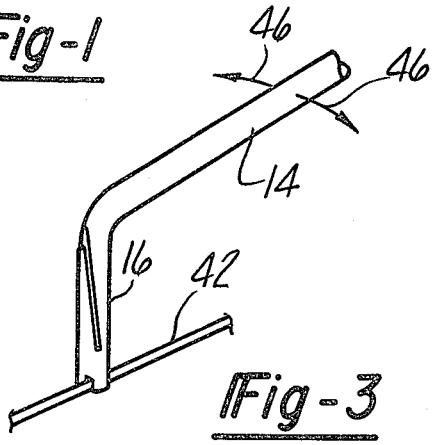
FIG. 3 is a fragmentary perspective view showing the carton opening device of the present invention engaging a retaining wire of a carton.
Figure 4:
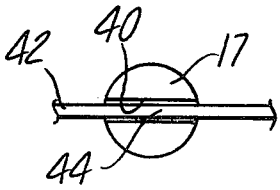
FIGS. 4 and 4A are fragmentary plan views showing the carton opening device of the present invention engaging a retaining wire and enlarged for clarity.

With reference now to FIGS. 1, 3 and 4, a diametric slot 40 is formed across the free end 17 of the handle second leg 16. The slot 40 is adapted to engage a carton retaining wire 42, or the like, so that a segment 44 of the wire 42 is completely received within the slot 40. Thereafter, the device 10 is rotated or pivoted about the longitudinal axis of the handle second leg 16 by moving the handle first leg 14 in the direction of arrows 46

Figure 4A:
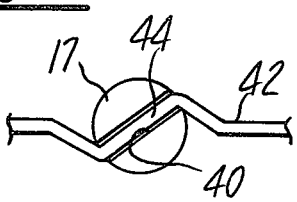

(FIG. 3). This rotation causes the carton retaining wire 42 to stretch, as best shown in FIG. 4A, and rapidly break.

With reference now particularly to FIGS. 1, 6, 7, and 8, an elongated slot 50 extends inwardly from a first point at the outer surface of the corner 18 toward a point axially spaced along the leg 16 and terminates short of the free end of leg 16 near the axis of leg 16. The slot 50 thus forms a V-shaped portion 55 along the outside 51 of the handle leg 16 and effecting increases the width of the slot 50 from its opening 52 to its closed end 54.

Figure 6:
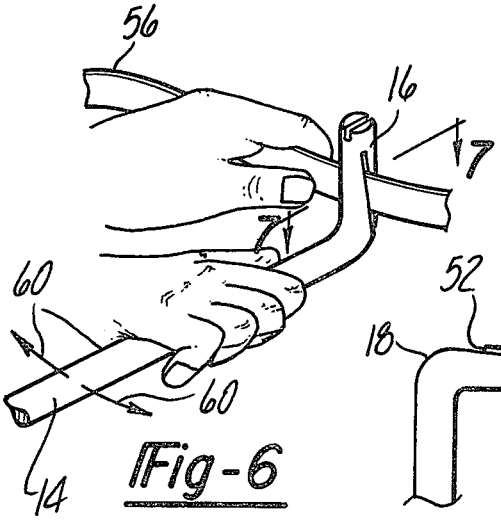
FIG. 6 is a fragmentary perspective view illustrating the carton opening device of the present invention engaging a carton retaining band.
Figure 8:
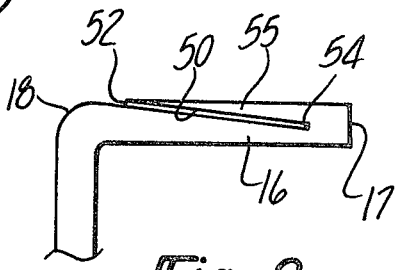
FIG. 8 is a fragmentary side plan view showing a portion of the device of the present invention.
Figure 7:
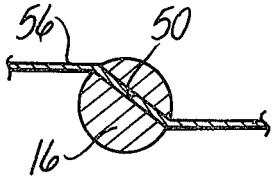
FIG. 7 is a fragmentary sectional view taken substantially along line 7—7 in FIG. 6.

As best shown in FIGS. 6, 7, and 8, the slot 50 is dimensioned to receive a carton retaining band 56 entirely therein. The V-shaped portion 55 enables rapid positioning of the band 56 within the slot 50 even if the band 56 is tightly wound around a carton. Thereafter, the handle first leg 14 is pivoted or rotated about the longitudinal axis of the handle second leg 14 as indicated by arrows 60. This rotation in combination with the wider width of the slot 50 at its closed end 54 stretches the carton retaining band 56 (FIG. 7) and causes the band 56 to rapidly break.

The handle first leg 14 is preferably substantially longer, for example, two-three times longer, than the handle second leg 16. This dimensioning enables a relatively large torque to be applied to the handle second leg 16 for breaking carton retaining wires 42 or retaining bands 56 while still enjoying a compact construction for the carton opening device 10.

It can, therefore, be seen that the device 10 according to the present invention provides a simple, inexpensive and yet totally effective device for opening cartons which are secured together in a plurality of diverse fashions.

Having described my invention, however, many modifications thereto, will become apparent to those skilled in the art to which it pertains without deviation from the spirit of the invention as defined by the scope of the appended claims.

I claim:

1. A carton opening device comprising, a substantially L-shaped handle having a first leg, a second leg, and a corner section joining said legs, the free end of said second leg having a diametric channel formed thereacross, said channel being adapted to engage a retaining wire on a carton whereby rotation of said first leg coaxially about said second leg stretches and breaks a retaining wire positioned in the channel, said second leg further having an elongated slot extending inwardly from a first point at the outer surface of said corner section toward a second point axially spaced along said second leg and terminating short of the free end of said second leg near the axis of said second leg, said slot being adapted to receive a retaining band of a carton and to break the band upon rotation of said handle about the axis of said second leg.

2. The invention as defined in claim 1, wherein said slot tapers radially inwardly from an opening on the outside of the handle second leg into said handle second leg.

3. The invention as defined in claim 1 and including a crowbar claw formed at the free end of the handle first leg.

4. The invention as defined in claim 1, wherein said crowbar claw further comprises two spaced and parallel portions extending axially outwardly from the free end of the first handle leg, said portions forming a U-shaped channel therebetween for engaging a nut.

* * * * *